US005755165A

United States Patent [19]

Sonoda et al.

[11] Patent Number: 5,755,165

[45] Date of Patent: May 26, 1998

[54] COAL FIRING DEVICE

[75] Inventors: Keisuke Sonoda; Toshiyuki Takegawa; Kimishiro Tokuda; Yoshinori Kobayashi, all of Nagasaki; Takaharu Toyoda; Fumiya Nakashima, both of Tokyo, all of Japan

[73] Assignee: Mitsubishi Jukogyo Kabushiki Kaisha, Tokyo, Japan

[21] Appl. No.: 505,642

[22] Filed: Jul. 21, 1995

[30] Foreign Application Priority Data

Aug. 31, 1994 [JP] Japan ..... 6-206567

[51] Int. Cl.[6] ..... F23D 1/02

[52] U.S. Cl. ..... 110/264; 110/263; 110/260; 110/261; 431/9; 431/10; 431/173

[58] Field of Search ..... 110/218, 229, 110/266, 263, 264, 261; 431/9, 10, 173

[56] References Cited

U.S. PATENT DOCUMENTS

| | | | |
|---|---|---|---|
| 4,352,675 | 10/1982 | Seipenbusch et al. | 48/73 |
| 4,428,727 | 1/1984 | Deussner et al. | 431/182 |
| 4,654,001 | 3/1987 | LaRue | 431/354 |
| 4,784,600 | 11/1988 | Moreno | 431/9 |
| 4,841,727 | 6/1989 | Wittchow et al. | 60/39.464 |
| 4,930,430 | 6/1990 | Allen et al. | 110/264 |
| 5,295,449 | 3/1994 | Maeda et al. | 110/229 |

FOREIGN PATENT DOCUMENTS

| | | |
|---|---|---|
| 351563 | 1/1990 | European Pat. Off. . |
| 400740 | 12/1990 | European Pat. Off. . |
| 576932 | 4/1946 | United Kingdom . |
| 840699 | 7/1960 | United Kingdom . |

*Primary Examiner*—Ira S. Lazarus
*Assistant Examiner*—Ljiljana V. Ciric
*Attorney, Agent, or Firm*—Wenderoth, Lind & Ponack

[57] ABSTRACT

An improvement of a coal firing device applied to coal gasifiers, boilers for power generation, etc. On the inner walls of a ceiling portion (4) of a firing furnace (3) and of a throat portion (2) thereabove, and of a diffuser portion (6) further thereabove, where necessary, plate-like vortex breaker(s) (1A, 1B) is/are provided. Vortex flow of gas in the vicinity of the inner wall surface around the throat portion (2) is thereby weakened and molten slag sticking on the wall surface is suppressed to be pushed up by the gas. There occurs neither staying of molten slag at the diffuser portion (6) nor scattering of slag, and blockade of furnace due to solid-phase slag does not occur.

6 Claims, 5 Drawing Sheets

COAL FIRING DEVICE

BACKGROUND OF THE INVENTION

1. Field of the Invention:

The present invention relates to a coal firing device applied to coal gasifiers, boilers, etc. for power supply utilities or other industrial uses.

2. Description of the Prior Art

FIG. 5 shows a longitudinal cross section of an example of a coal firing device of a heretofore known entrained bed coal gasifier.

Said coal firing device of an entrained bed coal gasifier comprises a cylindrical firing furnace 3 including a conical ceiling portion 4 thereof, a cylindrical throat portion 2, a conical diffuser portion 6 and a cylindrical reductor 7, all connected perpendicularly and concentrically in a form of the throat portion 2 being on the firing furnace 3, the diffuser portion 6 being on the throat portion 2 and the reductor 7 being on the diffuser portion 6, and the ceiling portion 4 of the firing furnace 3 being on the firing furnace 3 so as to connect to the throat portion 2.

Upon firing of coal (pulverized coal) and char thrown into from a firing equipment burner 8 provided circumferentially along the cylindrical firing furnace 3, firing gas is produced first and then combustible gas is produced by gasification. These high temperature produced-gases, being supplied into the conical diffuser portion 6 from an upper part of the firing furnace 3 via the cylindrical throat portion 2, are mixed with pulverized coal for gasification supplied from a reductor burner 5 and flow within the reductor 7 while gasification reaction is being made therewith.

On the other hand, ash component in the coal and char becomes molten slag and is centrifugally separated from the gas by vortex flow formed by the burner jet flow, and sticks on the inner wall surface of the cylindrical firing furnace 3. Then flowing down to a slag hole 9 provided at the bottom part of the firing furnace 3, it is discharged out of the firing furnace 3.

In such heretofore known coal firing device, a throat portion 2 is provided at the outlet of a firing furnace 3 for the purpose of i) increase of catching efficiency of molten slag in a firing furnace, ii) increase of staying time of gas, coal and char within a firing furnace and iii) securing of high temperatures within a firing furnace by way of confinement of radiant energy generated by firing. Due to such throat portion 2, an inclined (conical) ceiling portion 4 is inevitably formed on a firing furnace.

As shown in FIG. 6, molten slag 11 stuck by centrifugal force on the inner surface of the perpendicular wall of the firing furnace 3 flows down by gravity with vortex motions. However, at the ceiling portion 4 of the firing furnace 3 or at the throat portion 4, the vertical velocity component and the ascending velocity component of the vortex flow within the furnace increase, thereby the molten slag 12 sticking on the inner wall surfaces of the ceiling portion 4 and the throat portion 2 or of the diffuser portion 6 is pushed upwardly by the gas and stays at the diffuser portion 6 while it is always making vortex motions, as shown by numeral 13 of FIG. 6. Said stay of the molten slag 13 at the diffuser portion 6 is influenced by centrifugal force given by the vortex flow of the gas, gravity, etc.

Upon the molten slag staying at the diffuser portion, it is scattered by the gas flow from its staying zone as shown by numeral 16 of FIG. 7. If too much of the molten slag stays at the staying zone 13, ill balancing occurs and some of the molten slag flows down to the firing furnace 3, with some other scattering as shown by numeral 15 of FIG. 7. The scattering molten slag is blown off by the gas flow to the upper part of the diffuser 6 or further up to the reductor portion 7 and sticks on the wall surface there by centrifugal force. But at the upper part of the diffuser or at the reductor portion, gas temperature is lowered by gasification reaction, thereby the sticking molten slag there becomes solidified and gradually grows to solid-phase slag, and finally it grows to block the diffuser portion and the reductor portion, by which a long time continuous operation of the gasifier, etc. is hindered.

SUMMARY OF THE INVENTION

It is therefore an object of the present invention to provide a coal firing device which is free from the above-mentioned short-comings in the prior art.

The present invention relates to a coal firing device in which vortex firing of pulverized coal is made within a cylindrical firing furnace, ash component thereof being caught on a furnace wall by centrifugal force is dropped to the bottom part of the firing furnace and the produced-gas of firing is sent out of the furnace from a throat portion provided at the upper part of the firing furnace via a conical diffuser portion, wherein at least one plate-like vortex breaker is provided on the inner walls of a ceiling portion of the firing furnace and of the throat portion, or wherein, in addition to said conditions, at least one plate-like vortex breaker is provided on the inner wall surface of the diffuser portion, or further in addition thereto, said vortex breaker(s) is/are provided radially.

As the present invention, being so constructed as mentioned above, has vortex breaker(s) at the ceiling portion of the firing furnace and the throat portion, or further at the diffuser portion, the vortex flow of the gas in the vicinity of the inner wall surfaces of said portions is weakened and the vortex flow within the firing furnace does not reach to the diffuser portion or to the reductor portion. For this reason, the molten slag sticking on the wall surfaces of the ceiling portion and the throat portion or the diffuser portion is suppressed to be pushed up by the gas, and staying of the molten slag at the diffuser portion does not occur, thus a blockade of furnace due to solid-phase slag growing up at the diffuser portion or at the reductor portion does no longer occur.

DESCRIPTION OF THE PREFERRED EMBODIMENTS

Figure 1:
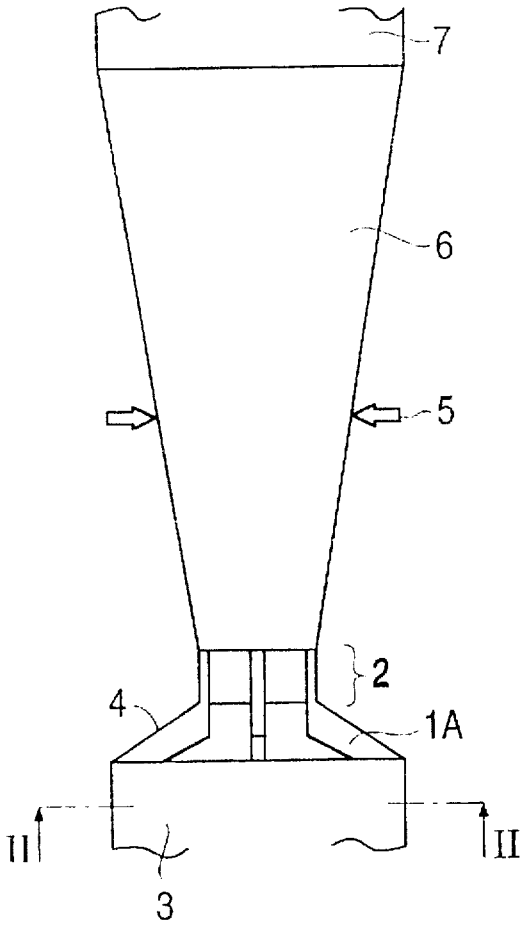
FIG. 1 is a longitudinal cross section showing a first preferred embodiment according to the present invention.
Figure 2:
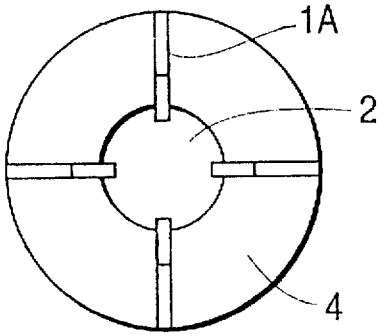
FIG. 2 is a horizontal sectional view taken on line II—II in a direction of arrows of FIG. 1.

FIG. 1 is a longitudinal cross section showing a first preferred embodiment according to the present invention and FIG. 2 is a horizontal sectional view taken on line II—II in a direction of arrows of FIG. 1.

Figure 6:
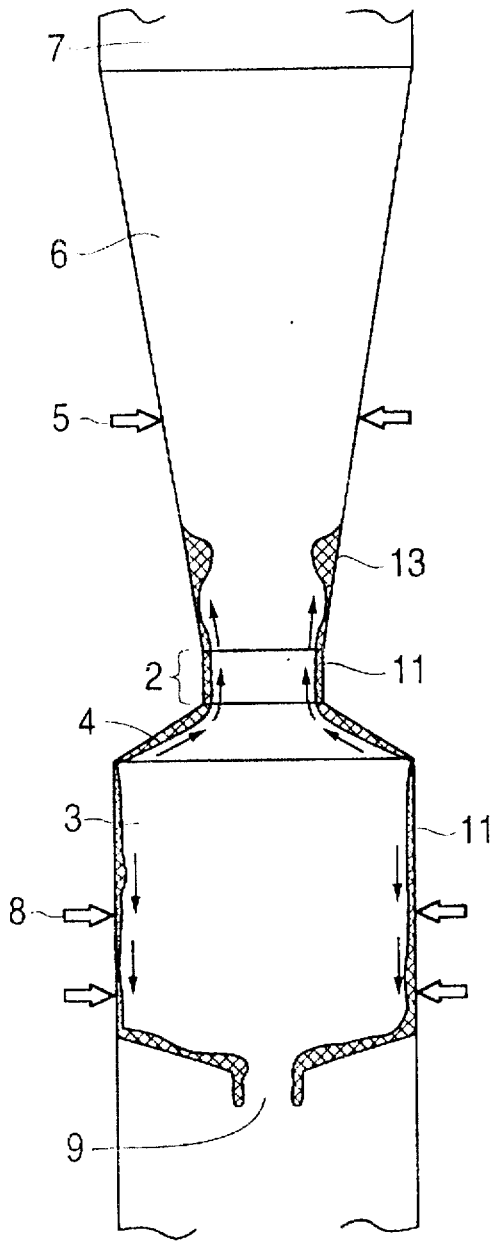
FIG. 6 PRIOR ART
FIG. 6 is a schematic illustration showing flow motions of molten slag on the inner wall surfaces of said coal firing device of the prior art.
Figure 7:
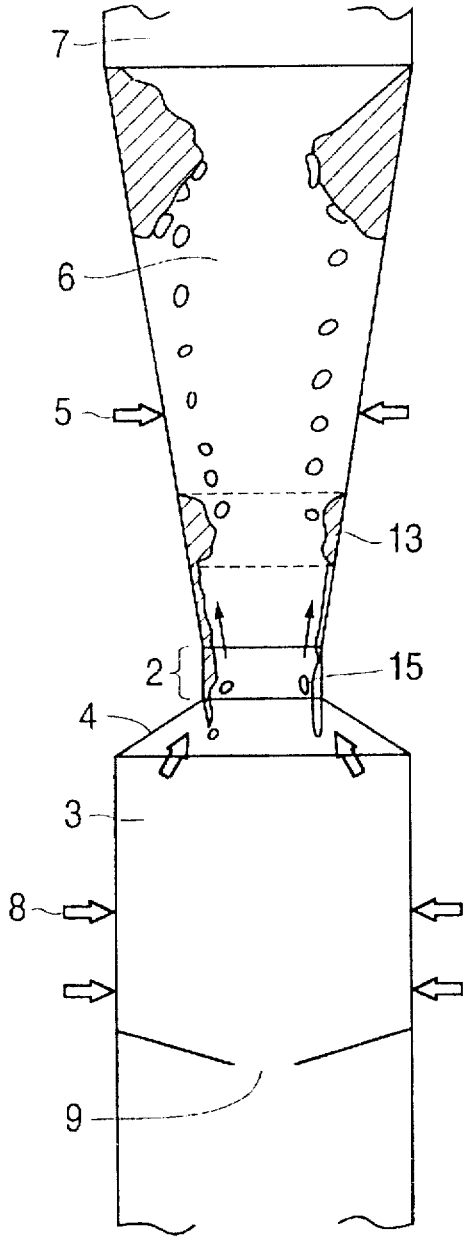
FIG. 7 PRIOR ART
FIG. 7 is a schematic illustration showing status of scattering, solidification and blockade of molten slag in said coal firing device of the prior art.

A first preferred embodiment is a coal firing device for an entrained bed coal gasifier comprising a firing furnace 3, a throat portion 2, a diffuser portion 6 and a reductor 7, same as those shown in FIG. 6, wherein a perpendicular strip plate-like vortex breaker is radially provided respectively at four positions with equal intervals in a circumferential direction on the inner walls of the conical ceiling portion 4 of the firing furnace 3 and the throat portion 2. The width of the plate is made wider at the ceiling portion 4 and narrower at the throat portion 2. As a result thereof, the molten slag sticking on the inner wall surfaces of the ceiling portion 4 and the throat portion 2 is no longer pushed up by the gas and there occurs no staying of the molten slag at the diffuser portion 6.

Figure 3:
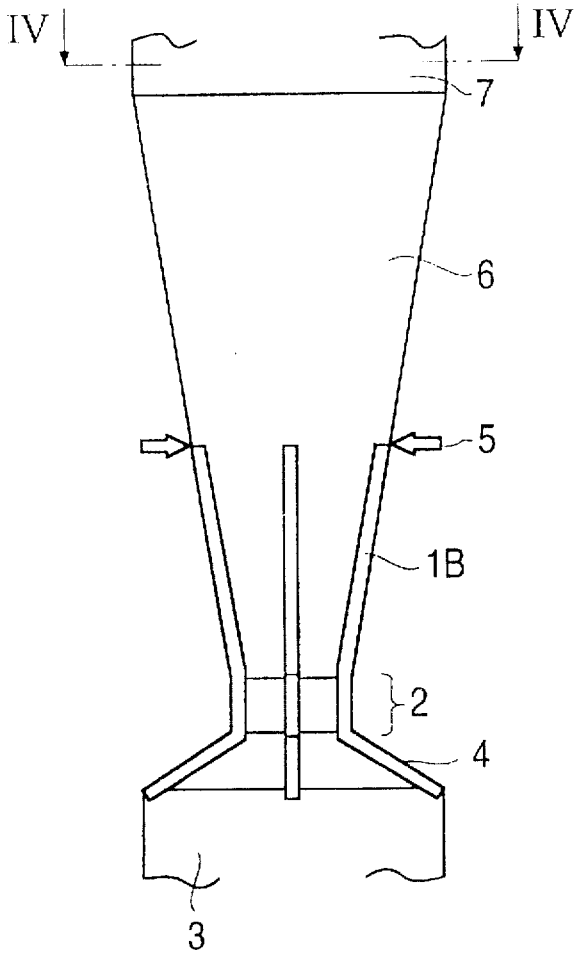
FIG. 3 is a longitudinal cross section showing a second preferred embodiment according to the present invention.
Figure 4:
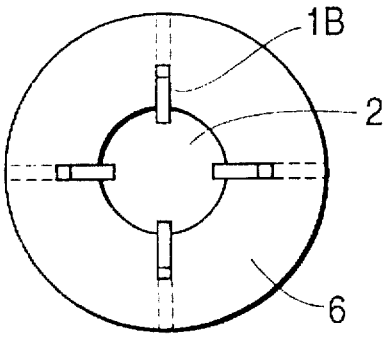
FIG. 4 is a horizontal sectional view taken on line III—III in a direction of arrows of FIG. 3.
Figure 5:
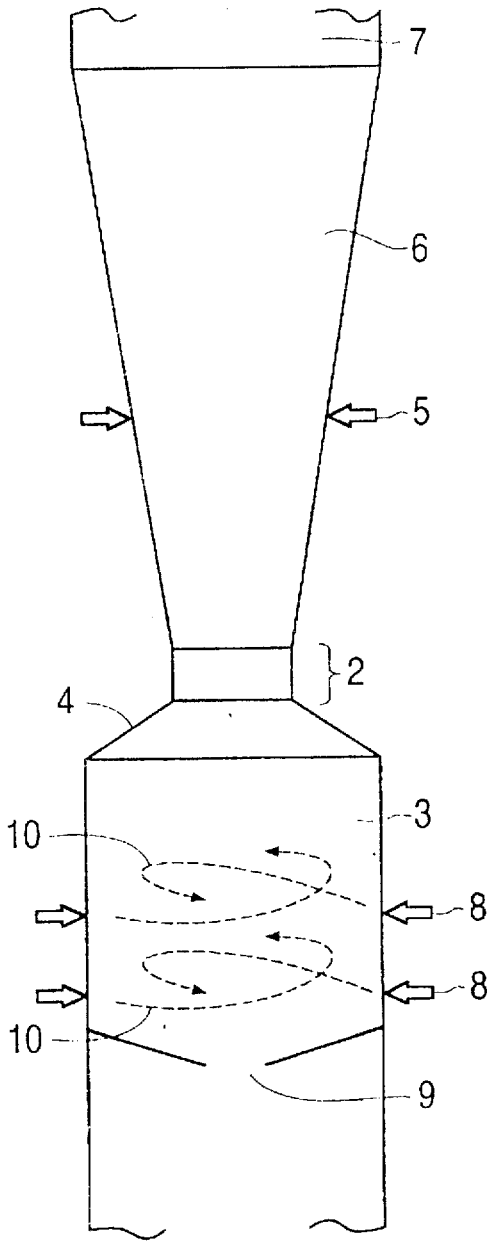
FIG. 5 PRIOR ART
FIG. 5 is a longitudinal cross section showing an example of a coal firing device for an entrained bed gasifier of the prior art.

FIG. 3 is a longitudinal cross section showing a second preferred embodiment according to the present invention and FIG. 4 is a horizontal sectional view taken on line IV—IV in a direction of arrows of FIG. 3.

A second preferred embodiment is of a construction in which, not only at a conical ceiling portion 4 of the firing furnace 3 and a throat portion 2 but also at a diffuser portion 6, a perpendicular plate-like vortex breaker of an equal width along the respective mother line is radially provided respectively at hour positions with equal intervals in a circumferential direction on the inner wall surfaces from the bottom end of the ceiling portion 4 to the position of a reductor burner 5. As a result thereof, in this preferred embodiment also, the molten slag sticking on the inner wall surfaces of the ceiling portion 4 and the throat portion 2 is no longer pushed up by the gas and there occurs no staying of the molten slag at the diffuser portion 6.

Besides the above preferred embodiments where vortex breakers 1A and 1B are provided at four positions in a circumferential direction, it is also confirmed that a vortex breaker provided only at one position has also a sizable effect.

According to the present invention, there occurs no staying zone of molten slag at a diffuser portion, thereby scattering of slag does not occur, and thus solid-phase slag which causes blockade of furnace does not occur. Accordingly, a long time continuous operation of furnace becomes possible.

While a principle of the present invention has been described above in connection with preferred embodiments of the invention, it is intended that all matter contained in the above description and illustrated in the accompanying drawings shall be interpreted to be illustrative and not in a limiting sense.

What is claimed is:

1. A coal-firing device for vortex firing of pulverized coal, said device comprising:

a cylindrical firing furnace;

a conical ceiling member having a small diameter end and a large diameter end connected to an upper portion of said cylindrical firing furnace; a throat structure connected to said small diameter end of said ceiling member;

a conical diffuser connected to an upper end of said throat structure; and at least one planar member projecting radially inward from an inner surface of said ceiling member and said throat structure, wherein said planar member extends axially relative to the central axis of said coal firing device, wherein each planar member has a width which is greater at said ceiling member than at said throat structure.

2. The coal-firing device as claimed in claim 1, wherein said at least one planar member extends axially so that it also projects inwardly from an inner surface of said conical diffuser.

3. The coal-firing device as claimed in claim 1, wherein said at least one planar member comprises a plurality of planar members equiangularly spaced from each other with respect to the central axis of said coal-firing device.

4. A coal-firing device for vortex firing of pulverized coal, said device comprising:

a cylindrical firing furnace an open-ended conical ceiling member connected to an upper portion of said cylindrical firing furnace, said conical ceiling member having a small diameter end and a large diameter end connected to an upper portion of said cylindrical firing furnace;

a throat structure connected to said small diameter end of said ceiling member;

a conical diffuser connected to an upper end of said throat structure; and a plurality of vertical planar members extending axially relative to the common central axis of said ceiling member, said throat structure and said conical diffuser, wherein said vertical planar members project radially inward from an inner surface of said ceiling member, an inner surface of said throat structure, and an inner surface of said conical diffuser.

5. The coal-firing device as claimed in claim 4, wherein said plurality of vertical planar members are equiangularly spaced from each other with respect to the common central axis of said ceiling member, said throat structure and said conical diffuser.

6. The coal-firing device as claimed in claim 4, wherein each vertical planar member has a uniform width in a radial direction.

* * * * *